US006102587A

United States Patent [19]

Tamaki

[11] Patent Number: 6,102,587

[45] Date of Patent: Aug. 15, 2000

[54] CONVEYANCE DIRECTION CHANGING DEVICE OF A PHOTOSENSITIVE MATERIAL IN AN AUTOMATIC DEVELOPING APPARATUS

[75] Inventor: Yoshikazu Tamaki, Wakayama, Japan

[73] Assignee: Noritsu Koki Co., Ltd., Wakayama, Japan

[21] Appl. No.: 09/099,509

[22] Filed: Jun. 17, 1998

[30] Foreign Application Priority Data

Jun. 17, 1997 [JP] Japan ..... 9-160029

[51] Int. Cl.[7] ..... G03D 3/08

[52] U.S. Cl. ..... 396/612; 396/618

[58] Field of Search ..... 396/612, 617, 396/620, 622, 618; 134/64 P, 122 P; 355/27–29; 226/170–172, 183; 492/28, 33, 57, 59, 56

[56] References Cited

U.S. PATENT DOCUMENTS

| | | | |
|---|---|---|---|
| 4,181,421 | 1/1980 | Kitrosser | 396/620 |
| 5,280,308 | 1/1994 | Takahashi et al. | 271/275 |
| 5,678,119 | 10/1997 | Tamaki | 396/618 |

FOREIGN PATENT DOCUMENTS

| | | |
|---|---|---|
| 2532828 | 2/1977 | Germany . |
| 2603659 | 4/1977 | Germany . |
| 2739542 | 3/1978 | Germany . |
| 19614341 | 10/1996 | Germany . |
| 8-339071 | 12/1996 | Japan . |

*Primary Examiner*—D. Rutledge
*Attorney, Agent, or Firm*—Randolph A. Smith, Smith Patent Office

[57] ABSTRACT

A changing device for changing a conveyance direction of a photosensitive material without causing it to move in a zigzag manner is provided. The changing device includes an endless belt in contact with a lower part of the outer surface of a turn roller. A tubular elastic member is fitted in the middle of the turn roller with respect to its widthwise direction. A photosensitive material fed between the turn roller and the belt by the rotation of the turn roller and movement of the belt is conveyed in a circumferential direction of the turn roller while being tightly held between the belt 12 and the elastic member 16. The photosensitive material can have its conveyance direction changed without being caused to move in a zigzag manner by the elastic member in substantially even contact therewith over the entire width thereof.

9 Claims, 4 Drawing Sheets

CONVEYANCE DIRECTION CHANGING DEVICE OF A PHOTOSENSITIVE MATERIAL IN AN AUTOMATIC DEVELOPING APPARATUS

BACKGROUND OF THE INVENTION

1. Field of the Invention

The present invention relates to a conveyance direction changing device for changing a conveyance direction of a photosensitive material in an automatic developing apparatus for developing the photosensitive material such as a photographic film and a photographic paper.

2. Description of the Related Art

In an automatic developing apparatus in which a variety of development solutions including a liquid developer, a liquid fixer and a liquid stabilizer are filled in treatment tanks and photosensitive materials are successively conveyed into the development solutions in the treatment tanks, racks are suspended in the respective treatment tanks and the photosensitive materials are conveyed in these racks.

Each rack is provided with a conveying device for the photosensitive material. The photosensitive material is conveyed, face down, by the conveying device and the photosensitive material has its conveyance direction changed by 180° using a conveyance direction changing mechanism provided at a bottom part of the rack so that the photosensitive material can be conveyed face up.

A known conveyance direction changing mechanism is shown in FIG. 5. This mechanism is constructed such that feed rollers 31, 32, 33 are arranged in contact with the opposite sides and bottom of a turn roller 30 that is drivingly rotated. Arcuate guides 34 are provided between adjacent feed rollers 31, 32, 33. A photosensitive material A fed to a contact portion between the turn roller 30 and the feed roller 31 at one side has its conveyance direction changed by 180° along a lower part of the outer surface of the turn roller 30 by the rotation of the turn roller 30 and the feed rollers 31, 32, 33.

Since the photosensitive material A is conveyed along the fixed guides 34 in the above conveyance direction changing mechanism, it is likely to be scratched by the contact with the guides 34. This presents a problem since the device sometimes does not provide good quality products.

In order to solve the above problem, a conveyance direction changing device having a small likelihood of scratching the photosensitive material was proposed in Japanese Unexamined Patent Publication No. 8-339071. FIG. 6 shows the conveyance direction changing device disclosed in the above mentioned publication. This device is constructed such that an endless belt 41 having a portion thereof held in contact with a lower part of the outer surface of a turn roller 40, rotated in one direction, is moved in a direction of the arrow at the same speed as the circumferential speed of the turn roller 40. This conveys a photosensitive material A fed between a contact portion, between the belt 41 and the turn roller 40, in a circumferential direction of the turn roller 40 while being tightly held between the turn roller 40 and the belt 41.

Since the photosensitive material A is tightly held between the turn roller 40 and the belt 41 in the above conveyance direction changing device, it is possible to have its conveyance direction changed without damaging the photosensitive material.

In the above device, the turn roller 40 and a plurality of belt rollers 42 for guiding the movement of the belt 41 are not necessarily precise rollers having an outer diameter uniform over the entire length. With the use of imprecisely dimensioned rollers or a mounting error in the location of the rollers, the belt 41 cannot be brought into even contact with the turn roller 40 over the entire width.

Here, if the contact pressure between the turn roller 40 and the belt 41 is uneven along the widthwise direction of the belt 41, the photosensitive material A that is conveyed while being tightly held between the turn roller 40 and the belt 41 slips in positions where the contact pressure is low. As a result, the photosensitive material A moves in a zigzag manner and the side edges thereof may be strongly brought into contact with side guides for guiding the movement of the side edges of the photosensitive material A, thereby being scratched. This disadvantageously results in a considerable reduction in product value.

It is an object of the present invention to change the conveyance direction of a photosensitive material without causing it to move in a zigzag manner in a changing device while tightly holding it between a turn roller and a belt.

SUMMARY OF THE INVENTION

In order to accomplish the above object, the invention is directed to a device for changing a conveyance direction of a photosensitive material in an automatic developing apparatus in which the photosensitive material is tightly held between a turn roller which is driven to rotate and an endless belt which is mounted such that a portion thereof is in contact with substantially the half of the outer surface of the turn roller. The conveyance direction of the photosensitive material is changed along the outer surface of the turn roller by the rotation of the turn roller and the movement of the belt, wherein a large diameter portion is provided in the middle of a turn roller with respect to its widthwise direction.

Preferably, the outer diameter of the large diameter portion is about 1.15 to 1.2 times that of the turn roller in order to effectively prevent the photosensitive material from moving in a zigzag manner.

If the opposite ends of the outer surface of the large diameter portion are edged, these edges may be strongly brought into contact with the photosensitive material, thereby scratching it. Accordingly, it is preferable to bevel the opposite ends of the large diameter portion.

The large diameter portion may be formed by fitting a tubular elastic member having a chemical resistance on the turn roller which has the same diameter over the entire length. Materials for the elastic member include silicone rubber, fluororubber, ethylene rubber, soft vinyl chloride resin, and elastomer.

If a fine uneven portion is formed on the entire outer surface of the tubular elastic member, a frictional resistance to the photosensitive material is enhanced. As a result, the photosensitive material can be securely conveyed without slipping.

BRIEF DESCRIPTION OF THE DRAWINGS

The above objects and features of the present invention will be apparent to those skilled in the art from the following description of the preferred embodiments thereof when considered in conjunction with the appended drawings in which.

DETAILED DESCRIPTION OF THE PREFERRED EMBODIMENTS

Figure 1:
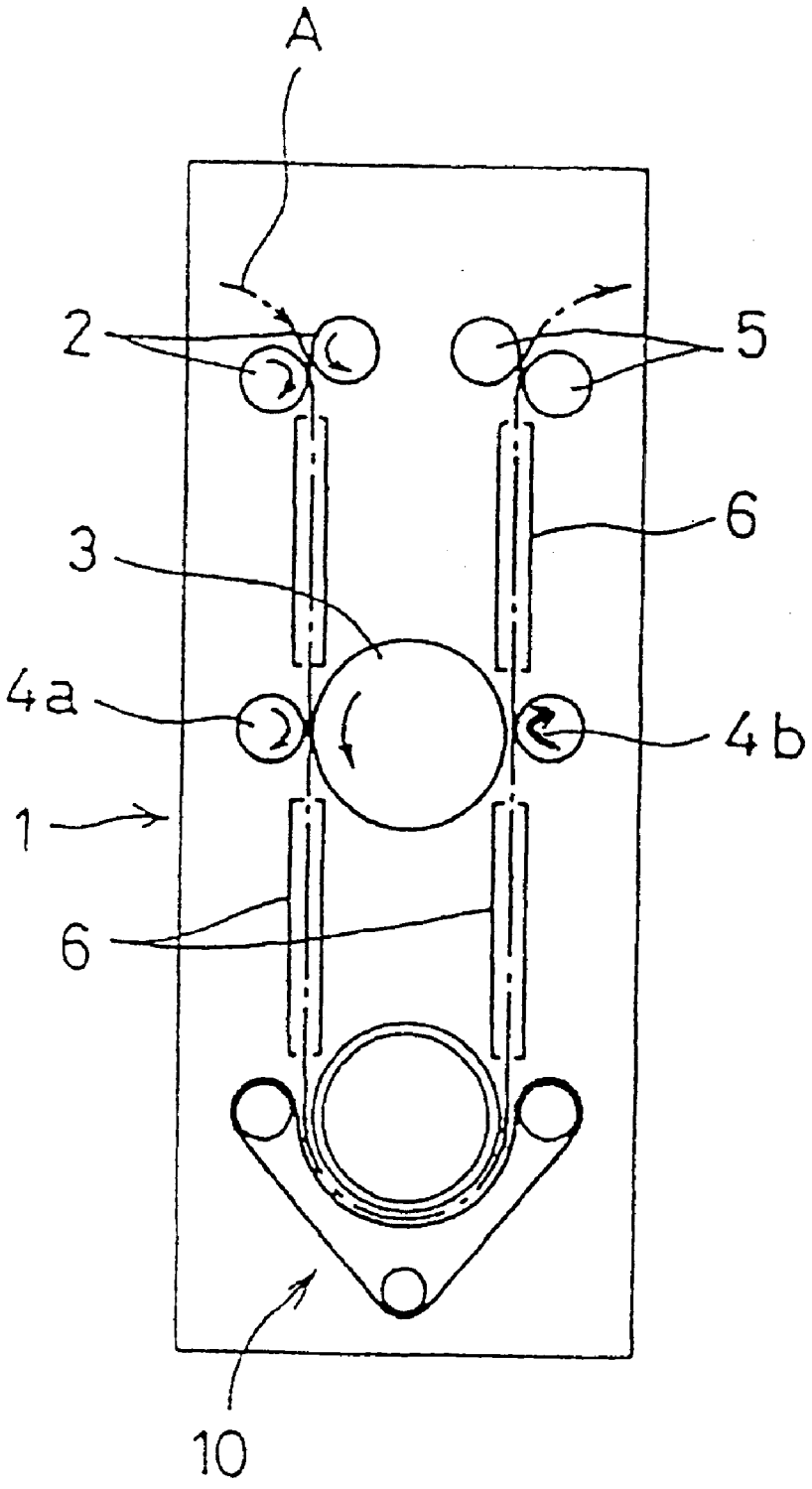
FIG. 1 is a schematic diagram of a rack provided with a conveyance direction changing device according to the invention.

FIG. 1 schematically shows a rack 1 for conveying a photosensitive material which is suspended in a treatment tank of an automatic developing apparatus. The rack 1 is provided at its upper part with a pair of feed rollers 2 for conveying a photosensitive material A, face down, by their rotation. At one side of a conveyance path of the photosensitive material A is provided an intermediate conveyance roller 3. Pressing rollers 4*a,* 4*b* are in contact with the opposite sides of the intermediate conveyance roller 3.

The intermediate conveyance roller 3 and the pressing rollers 4*a,* 4*b* are rotated in the directions of their respective arrows in FIG. 1 and the photosensitive material A is further conveyed downwardly by the intermediate conveyance roller 1 and the pressing roller 4*a.*

At a bottom part of the rack 1 is provided a changing device 10 for changing the conveyance direction of the photosensitive material A by 180°. The photosensitive material having its conveyance direction changed by the changing device 10 is conveyed, face up, by the intermediate conveyance roller 3 and the pressing roller 4*b,* and is discharged from the rack 1 by a pair of discharge rollers 5 provided at the upper part of the rack 1.

Along the conveyance path of the photosensitive material A are provided side guides 6 for guiding the movement of the side edges of the photosensitive material A.

Figure 2:
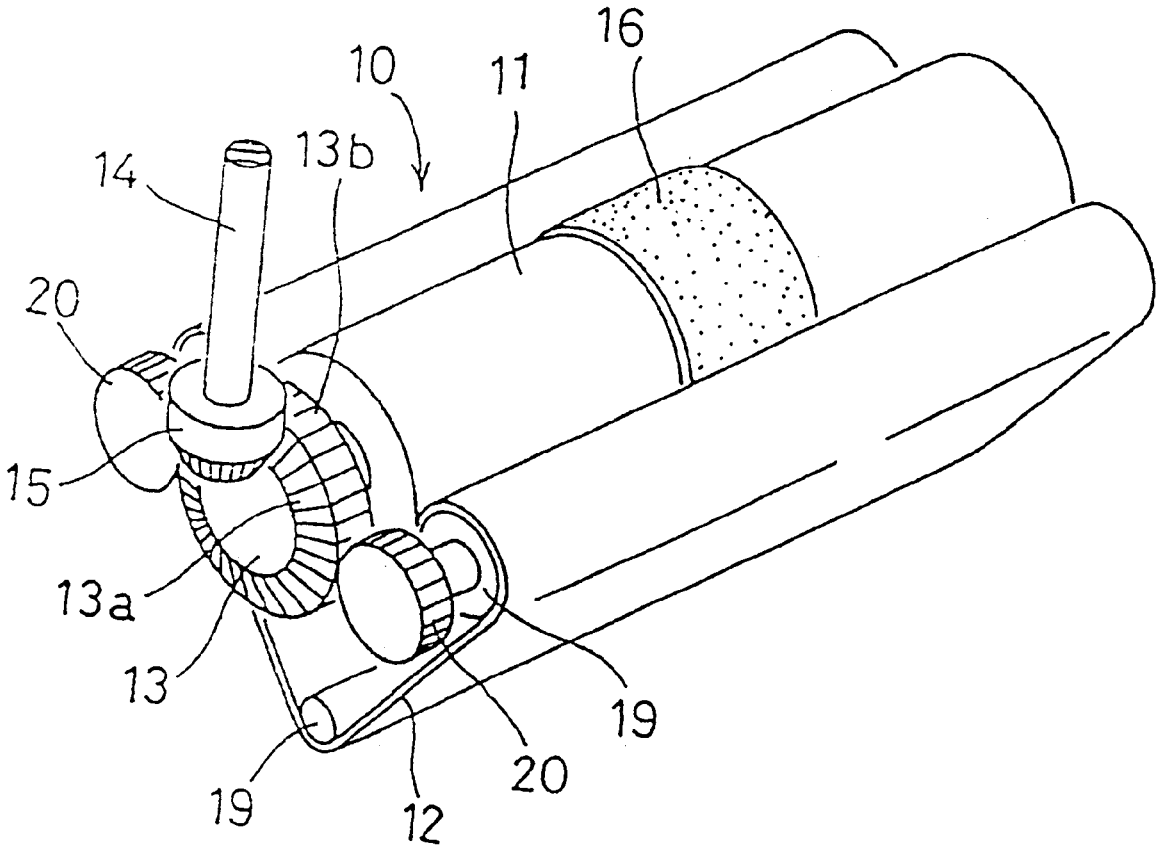
FIG. 2 is a perspective view of the conveyance direction changing device shown in FIG. 1.
Figure 3:
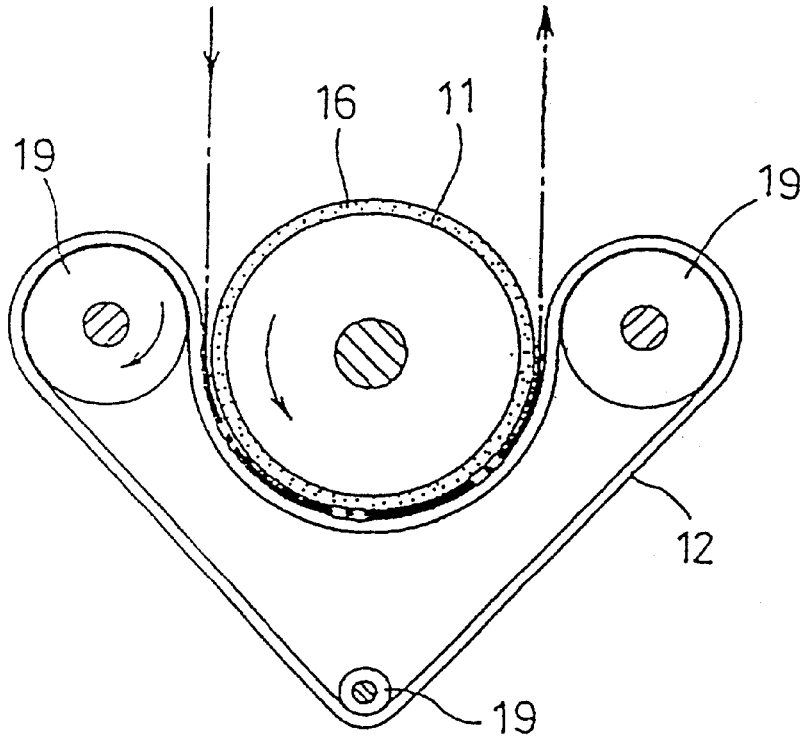
FIG. 3 is a cross sectional view of the conveyance direction changing device shown in FIG. 1.
Figure 4:
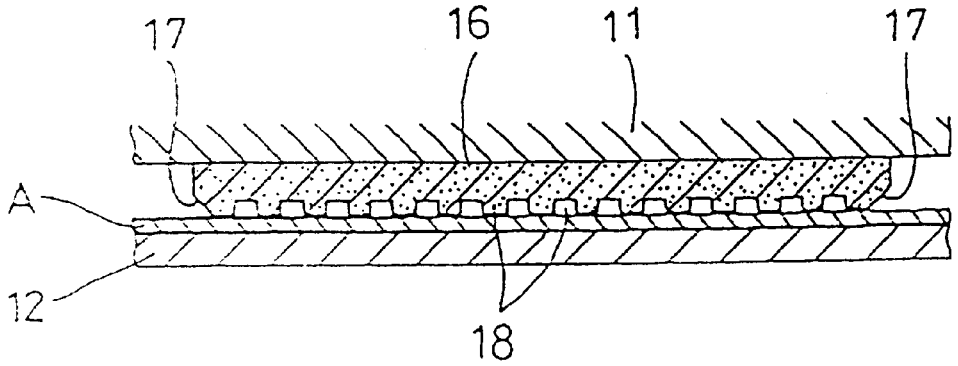
FIG. 4 is an enlarged cross sectional view showing a part of the conveyance direction changing device according to the present invention.
Figure 5:
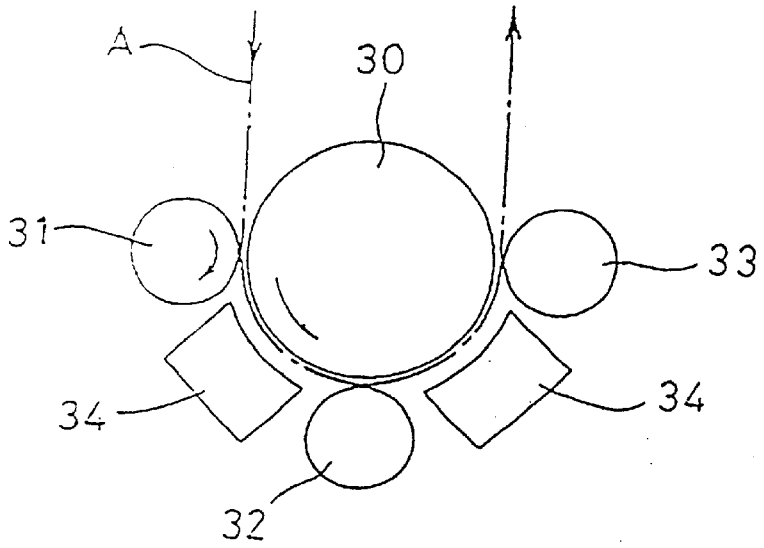
FIG. 5 (PRIOR ART)
FIG. 5 is a schematic diagram of a prior art conveyance direction changing device.
Figure 6:
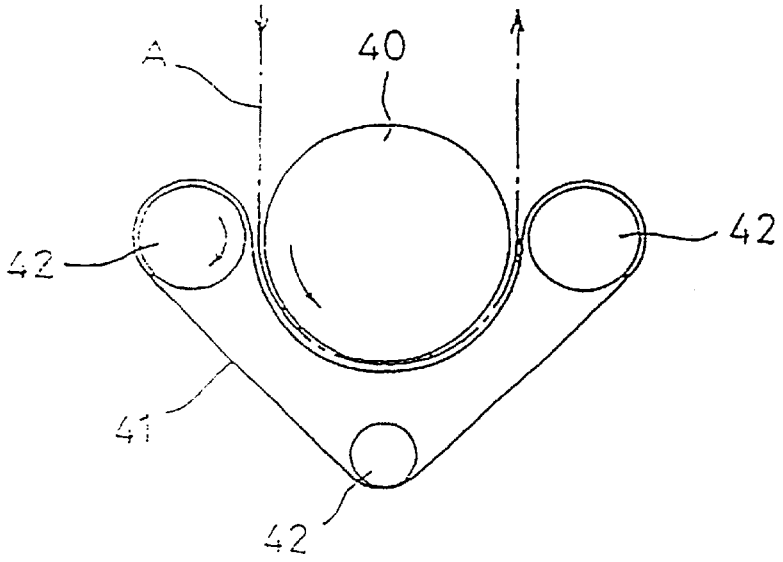
FIG. 6 (PRIOR ART)
FIG. 6 is a schematic diagram of another prior art conveyance direction changing device.

FIGS. 2 to 4 show in detail the changing device 10 for changing the conveyance direction of the photosensitive material A. The changing device 10 is comprised of a turn roller 11 and an endless belt 12. A gear 13 mounted on an end of a shaft of the turn roller 11, and a bevel gear portion 13*a* thereof is in mesh with a bevel gear 15 on a drive shaft 14 arranged at a right angle to the turn roller 11. The turn roller 11 is rotated in a direction of the arrow in FIG. 3 by the rotation of the drive shaft 14.

A large diameter portion 16 is provided in the middle of the turn roller 11 with respect to its widthwise direction. The large diameter portion 16 is made from a tubular elastic member and is secured to the turn roller 11 by an adhesive means. The elastic member 16 is made of silicone rubber, fluororubber, ethylene rubber, soft vinyl chloride resin, elastomer, or the like and has a chemical resistance.

The outer diameter of the elastic member 16 is about 1.15 to 1.2 times that of the turn roller 11, and the length thereof is about ⅕ of the length of the turn roller 11. As shown in FIG. 4, bevelled portions 17 are formed at the opposite longitudinal ends of the elastic member 16. The bevelled portions 17 may be slanted or rounded. Further, a fine uneven portion 18 is formed on the outer surface of the elastic member 16 over its entire width.

The belt 12 has a width substantially equal to the length of the turn roller 11 and is made of a material having a chemical resistance such as silicone rubber, polypropylene, polyvinyl chloride, polyphenylene oxide, polyethylene, or epoxy resin. A conductive belt formed by covering the surface of a fabric made of polyester with MIRABL urethane (MPU), nitrile rubber (NBR) or chloroprene rubber (CR) may be used as the belt 12.

The belt 12 is fitted on three belt rollers 19 such that a portion thereof is in contact with a lower part of the outer surface of the tubular elastic member 16. On one end of each of the belt rollers 19 arranged at the opposite sides of the turn roller 11 is mounted a spur gear 20 in mesh with a spur gear portion 13*b* of the gear 13 to transmit the rotation of the turn roller 11. As a result, the belt 12 is moved in a direction of the arrow in FIG. 3.

When the photosensitive material A is fed between the turn roller 11 and the belt 12 while the turn roller 11 is rotated and the belt 12 is moved, it is conveyed in a circumferential direction of the turn roller 11 while being tightly held between the elastic member 16 and the belt 12, thereby changing the conveyance direction thereof. The photosensitive material A, after the change of the conveyance direction, is conveyed upward between the belt 12 and the elastic member 16 while the opposite side edges thereof are guided by the side guides 6 shown in FIG. 1.

Since the tubular elastic member 16 for tightly holding the photosensitive material A is provided in the middle of the turn roller 11 with respect to its widthwise direction and is itself elastic, it is in substantially even contact with the photosensitive material A over its entire width. Thus, the photosensitive material A can have its conveyance direction changed without being moved in a zigzag manner. Also, undesirable event where the side edges of the photosensitive material A are strongly brought into contact with the side guides 6 does not occur.

Further, since the bevelled portions 17 are formed at the opposite ends of the elastic member 16, these ends are not strongly brought into contact with the photosensitive material A, thereby preventing the photosensitive material A from being scratched.

As described above, according to the invention, a contact pressure to the photosensitive material can be made substantially uniform over the entire width of the turn roller by providing the large diameter portion in the middle of the turn roller with respect to its widthwise direction.

Further, the application of bevelling to the opposite ends of the outer surface of the large diameter portion prevents these ends from being strongly brought into contact with the photosensitive material, which in turn prevents linear scratches from being made in the photosensitive material.

Furthermore, contact pressure to the photosensitive material can be made more uniform by forming the large diameter portion by the tubular elastic member. This can effectively prevent the photosensitive material from moving in a zigzag manner and also can prevent a relative slip of the photosensitive material with respect to the large diameter portion.

Further, the relative slip of the photosensitive material can more effectively be prevented by forming the fine uneven portion on the entire outer surface of the elastic member.

Although the present invention has been fully described by way of example with reference to the accompanying drawings, it is to be understood that various changes and modifications will be apparent to those skilled in the art. Therefore, unless such changes depart from the scope of the invention as defined by this specification and claims, they should be construed as being included herein.

What is claimed is:

1. A device for changing a conveyance direction of a photosensitive material in an automatic developing apparatus comprising:

a turn roller capable of being drivingly rotated, said turn roller including a main diameter portion being provided in a middle portion of said turn roller with respect to a widthwise direction of said turn roller;

an endless belt disposed so that a portion thereof is in contact with substantially half of an outer surface of said turn roller, wherein the photosensitive material is tightly held between said turn roller and said endless belt and the conveyance direction of the photosensitive material is changed along the outer surface of said turn roller by the rotation of said turn roller and movement of said endless belt;

wherein opposite ends of an outer surface of the large diameter portion have bevelled surfaces.

2. A conveyance direction changing device as defined in claim 1, wherein the large diameter portion comprises a tubular elastic member mounted on the turn roller and said tubular elastic member having a chemical resistance.

3. A conveyance direction changing device as defined in claim 2, wherein said tubular elastic member is made of silicone rubber, fluororubber, ethylene rubber, soft vinyl chloride resin, or elastomer.

4. A conveyance direction changing device as defined in claim 2, wherein an outer surface of said tubular elastic member includes a fine uneven surface portion.

5. A conveyance direction changing device as defined in claim 3, wherein an outer surface of said tubular elastic member includes a fine uneven surface portion.

6. A device for changing a conveyance direction of a photosensitive material in an automatic developing apparatus comprising:

a turn roller capable of being drivingly rotated, said turn roller including a main diameter portion being provided in a middle portion of said turn roller with respect to a widthwise direction of said turn roller:

an endless belt disposed so that a portion thereof is in contact with substantially half of an outer surface of said turn roller, wherein the photosensitive material is tightly held between said turn roller and said endless belt and the conveyance direction of the photosensitive material is changed along the outer surface of said turn roller by the rotation of said turn roller and movement of said endless belt;

wherein the large diameter portion comprises a tubular elastic member mounted on the turn roller and said tubular elastic member having a chemical resistance.

7. A conveyance direction changing device as defined in claim 6, wherein said tubular elastic member is made of silicone rubber, fluororubber, ethylene rubber, soft vinyl chloride resin, or elastomer.

8. A conveyance direction changing device as defined in claim 6, wherein an outer surface of said tubular elastic member includes a fine uneven surface portion.

9. A conveyance direction changing device as defined in claim 7, wherein an outer surface of said tubular elastic member includes a fine uneven surface portion.

* * * * *